US008536076B1

(12) United States Patent
Byles

(10) Patent No.: US 8,536,076 B1
(45) Date of Patent: Sep. 17, 2013

(54) THERMAL ENERGY RESISTANT TEXTILE FLEECE FABRIC FOR USE IN SAFETY APPAREL

(75) Inventor: Michael N. Byles, High Point, NC (US)

(73) Assignee: Innovative Textiles, Inc., High Point, NC (US)

( * ) Notice: Subject to any disclaimer, the term of this patent is extended or adjusted under 35 U.S.C. 154(b) by 246 days.

(21) Appl. No.: 12/799,872

(22) Filed: May 4, 2010

(51) Int. Cl.

| | |
|---|---|
| ***D04B 1/22*** | (2006.01) |
| ***D04B 7/28*** | (2006.01) |
| ***D04B 1/02*** | (2006.01) |
| ***D04B 1/04*** | (2006.01) |

(52) U.S. Cl.
USPC ..... 442/312; 442/304; 442/318; 428/920; 428/921

(58) Field of Classification Search
USPC ..... 442/304–319; 428/920, 921
See application file for complete search history.

(56) References Cited

U.S. PATENT DOCUMENTS

| | | | | |
|---|---|---|---|---|
| 4,196,574 | A | 4/1980 | Rhash | |
| 5,496,623 | A | 3/1996 | Fox | |
| 5,503,916 | A | 4/1996 | Ichibori et al. | |
| 5,727,401 | A * | 3/1998 | Statham | 66/176 |
| 5,824,614 | A | 10/1998 | Gadoury | |
| 6,089,052 | A * | 7/2000 | Riegger | 66/195 |
| 7,087,300 | B2 | 8/2006 | Hanyon et al. | |
| 7,537,831 | B2 | 5/2009 | Zhu et al. | |
| 2005/0208855 | A1 | 9/2005 | Zhu | |
| 2006/0090272 | A1 * | 5/2006 | Mio et al. | 8/531 |
| 2006/0116043 | A1 | 6/2006 | Hope et al. | |
| 2007/0066175 | A1 | 3/2007 | Wolf et al. | |
| 2007/0077839 | A1 | 4/2007 | McKinnon et al. | |
| 2007/0137012 | A1 | 6/2007 | Laton | |
| 2008/0057807 | A1 | 3/2008 | Tutterow et al. | |
| 2009/0049579 | A1 | 2/2009 | Roberts | |
| 2009/0176429 | A1 | 7/2009 | Chang et al. | |

FOREIGN PATENT DOCUMENTS

| | | |
|---|---|---|
| WO | 03/017793 | 3/2003 |

OTHER PUBLICATIONS

Fleece, Textile Glossary, copyright 2001, Celanese Acetate.*
Chapter 13, Spencer, Knitting Technology, 3rd edition, Woodhead Publishing, copyright 1989, 2001.*
Chapter 6.8, Spencer, Knitting Technology, 3rd edition, Woodhead Publishing, copyright 1989, 2001.*
Arc Flash Clothing, published on www.electricityforum.com online copyright 2006.*
Electrical Arc Flash Clothing, published on www.highvoltageinfo.com online copyright 2006-2007.*

* cited by examiner

*Primary Examiner* — Jennifer A Steele
(74) *Attorney, Agent, or Firm* — K&L Gates LLP

(57) ABSTRACT

A textile fleece fabric having a resistance to thermal energy from exposure to momentary electric arcs or flame so as to be suitable for use in safety apparel is made of three integrated layers including inner and outer layers on opposite sides of an intervening middle layer. The inner and outer layers are comprised predominately of textile fibers which have inherent or additive flame resistant properties, and the middle layer is comprised substantially entirely of textile fibers without inherent or additive flame resistant properties. The textile fibers of one of the inner or outer layers have a raised nap forming a fleece surface.

4 Claims, 1 Drawing Sheet

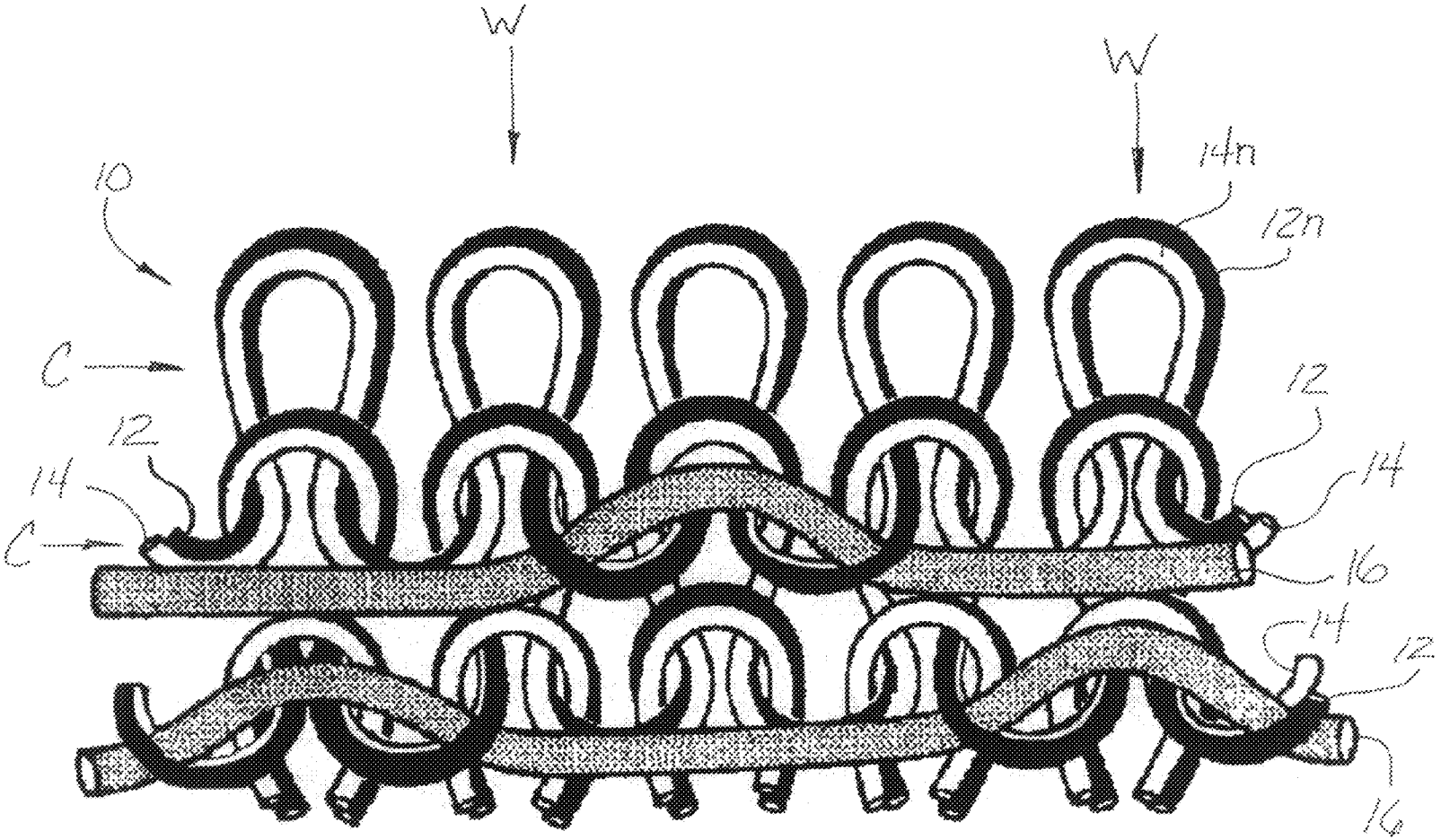
W
W
14n
12n
12
14
16
14
12
16
10
12
14

THERMAL ENERGY RESISTANT TEXTILE FLEECE FABRIC FOR USE IN SAFETY APPAREL

BACKGROUND OF THE INVENTION

The present invention relates generally to textile fabrics suitable for use in safety apparel. More particularly, the present invention relates to such fabrics which have a resistance to thermal energy from exposure to momentary electric arcs or flame.

Workers in many occupations are exposed to various personal safety hazards which can be mitigated by wearing safety apparel having selected properties such as a resistance to thermal energy from exposure to momentary electric arcs or flame. In the electric utility industry in particular, workers may be exposed to electric arcs from utility lines, transformers and other equipment, which can produce severe burn injuries and even death. Such injuries can be exacerbated if the clothing worn by an exposed worker ignites or melts from the thermal energy produced by an electric arc.

It is accordingly desirable for electric utility workers, as well as workers in other industries with similar concerns as to incidents of electric arc exposure, to wear apparel having flame resistant properties. A standard has also been promulgated by ASTM International, of West Conshohocken, Pa., formerly known as the American Society for Testing and Materials, establishing a test methodology for determining a relative rating of differing clothing materials for electric arc resistance, designated as the ASTM F1959-2004 standard. Under this testing methodology, textile fabrics are subjected to flame under defined conditions and each fabric receives a numerical rating, commonly referred to as the arc rating, that constitutes the number of calories per square centimeter the fabric will withstand when subjected to such testing. Thus, the higher a fabric's arc rating, the more resistant it has to flammability. Arc ratings are classified into four categories: Category 1 with ratings between 4 and 7.9, Category 2 with ratings between 8 and 24.9, Category 3 with ratings between 25 and 39.9, and Category 4 with ratings above 40.

Conventional wisdom in the textile fabric industry is that, in order to achieve Category 3 or Category 4 arc ratings, safety apparel fabrics must be made predominately of flame resistant or flame retardant materials, such as yarns with a relatively high content of modacrylic fiber, as modacrylic fibers are known to have good flame resistant properties. However, modacrylic fibers are also known to have low tensile strength and are also relatively expensive. Hence, flame retardant modacrylic yarns are typically made by blending modacrylic fibers with a lesser proportion of other fibers such as cotton to impart strength, producing a predominately modacrylic yarn suitable for apparel use. Generally, the industry considers that the total modacrylic content of a safety fabric must be at least 55% or greater to achieve a Category 3 arc rating.

For example, one typical conventional safety apparel fabric is made of a three-ply fleece construction utilizing three ends of yarns, each of a 55%/45% modacrylic/cotton blend to result in an overall 55% modacrylic content in the fabric as a whole. The three-ply structure of such a fabric gives it a weight suitable for various types of outerwear, e.g., sweatshirts and lightweight jackets, and when brushed or napped on one surface to raise the loft of surface fibers into a fleece-type surface, an enhanced hand and improved insulative character are imparted to the fabric. Such a fleece fabric made in a weight of about 16 ounces per square yard would typically have an arc rating of about 25, at the lowest threshold of a Category 3 range of arc ratings. Safety apparel fabrics are also known to be made in a three-ply fleece construction entirely of cotton fibers, but the fabric must be chemically treated to impregnate the entirety of the fabric with a flame resistance additive in order to achieve a moderately satisfactory arc rating within the upper end of the Category 2 range of arc ratings.

While such known fleece fabrics are usually adequate for fabrication of conventional safety apparel, a need exists within the textile industry for an alternative fabric having at least comparable physical properties (e.g., weight, strength, drapeability, hand, etc.) suitable for fabrication of safety apparel while also providing higher Category 3 or 4 arc ratings with lower cost constituent fibers.

SUMMARY OF THE INVENTION

The present invention seeks to address the above-described need by providing an improved textile fleece fabric suitable for use in safety apparel that has an enhanced resistance to thermal energy from exposure to momentary electric arcs or flame yet is made with a lesser proportionate content of flame retardant fibers as compared to know conventional safety apparel fabrics such as those described above.

Basically, the fabric of the present invention comprises three integrated layers including inner and outer layers on opposite sides of an intervening middle layer, with the inner and outer layers being comprised predominately of textile fibers which have inherent or additive flame resistant properties while the middle layer is comprised substantially entirely of textile fibers without inherent or additive flame resistant properties. The textile fibers of one of the inner or outer layers has a raised nap forming a fleece surface.

In most embodiments, the preferred flame resistant fiber for the yarns of the inner and outer layers is a modacrylic fiber, but with the entire fabric comprising less than 50% modacrylic fibers and preferably approximately 35% or less modacrylic fibers, measured by weight. Typically, the inner and outer layers are formed of yarns predominately comprising modacrylic fibers while the middle layer is formed of a yarn predominately comprising cotton fibers untreated with any flame resistant material. For example, in one preferred embodiment, the yarns of the inner and outer layers comprise approximately 55% modacrylic fibers and approximately 45% cotton fibers and the yarns of the middle layer comprise approximately 80% cotton fibers and approximately 20% polyester fibers, wherein the entire fabric comprises approximately 35% modacrylic fibers and approximately 65% cotton and polyester fibers without inherent or additive flame resistant properties.

Surprisingly and unexpectedly, such a preferred embodiment of the fabric of the present invention has been found to achieve a remarkably greater arc rating than the known conventional safety apparel conventional fabrics described above, despite having an overall fiber content that is predominately of fibers having no inherent or additive flame resistant properties. More specifically, in the preferred embodiment described above, the fabric has a Category 3 arc rating as measure by ASTM Standard F1959, which has tested at a 33.6 arc rating, substantially exceeding that of the comparable known three-ply fleece fabrics.

In preferred textile fleece fabrics according to the present invention, the yarns are interknitted in a three-ply knit structure, most preferably a circular knit structure. For example, the circular knit structure may comprise the outer layer yarn and the middle layer yarn interknitted with one another in a pattern of knit stitches and the inner layer yarn inlaid into the stitch pattern of one of the outer layer and middle layer yarns.

BRIEF DESCRIPTION OF THE DRAWING

FIG. 1 depicts diagrammatically in elevation the knitted structure of a textile fabric according to one preferred embodiment of the present invention.

DETAILED DESCRIPTION OF THE PREFERRED EMBODIMENTS

Referring now to the accompanying drawing, a fragmentary portion of a textile fabric according to the present invention is shown at 10 in a representative embodiment fabricated by circular knitting. As more fully explained below, the fabric 10 is of a known three-ply fleece knit structure knitted on a circular knitting machine which is also commonly known within the industry, but uniquely the present fabric 10 is fabricated using an unconventional combination of yarns which departs from the conventional wisdom and teachings in the industry yet surprisingly achieves unique and unexpected arc resistance properties to be especially suitable for use as a thermal barrier in safety apparel.

Appropriate circular knitting machines basically have a large-diameter rotatable needle cylinder with axial needle slots formed at a spacing from one another about the outer circumferential surface of the cylinder with a plurality of knitting needles, typically latch-type needles each having a yarn receiving hook and a closeable latch assembly, reciprocably disposed within the axial cylinder slots. Knitting reciprocation of the needles is controlled by stationary needle-actuating cams positioned outwardly about and adjacent to the needle cylinder. Multiple yarn feeding and knitting stations are spaced about the circumference of the knitting machine at which yarn feeding fingers or other feeding instruments are positioned for yarn feeding disposition adjacent the upper end of the needle cylinder to feed yarn to the needles thereat.

As yarns are fed to the rotating needle cylinder during operation, the needles are operatively manipulated within the respective slots of the cylinder by the adjacent stationary cams to form the yarns into knit stitches extending in circumferential courses and axial wales. As the knitting of the fabric 10 proceeds in this fashion over successive ongoing revolutions of the knitting machine, the yarns are knitted into a continuous seamless length of tubular fabric 10 of a desired length.

The fragmentary portion of the fabric 10 shown in the accompanying drawing depicts the stitch pattern of the three-ply fleece structure over a series of successive fabric courses C and adjacent wales W representing one repeat of the stitch pattern. Three yarns 12, 14, 16 make up the fabric structure. The yarn 12 constitutes a so-called face yarn formed in needle loops 12*n* in a jersey stitch pattern appearing in every fabric wale W and course C predominately at the technical face of the fabric structure to form an outer ply or layer of the fabric. The yarn 14 is interknitted with the face yarn in the same jersey stitch pattern forming needle loops 14*n* in every fabric wale W and course C interiorly of the face yarn 12 to form an intermediate middle ply or layer of the fabric. The yarn 16 constitutes a so-called pile or nap yarn inlaid without formation in needle loops into every fabric course C within selected spaced needle loops 12*n* of the face yarn 12 in an inlay pattern which varies from course to course and repeats every four wales and every four courses to form an inner ply or layer of the fabric appearing predominately at the technical back of the fabric. In this manner, the face yarn 12 serves as a so-called tie yarn to integrate or tie the pile yarn 16 into the stitch structure of the fabric 10.

The inlaid integration of the pile yarn 16 into the stitch structure of the fabric 10 advantageously enables the pile yarn to be subjected to a napping or brushing treatment during finishing of the fabric 10, wherein the surface of the technical back of the fabric is passed over one or more rotating cylinders clothed with wire points, teeth, or burrs effective to engage and raise the constituent fibers of the pile yarn 16 to impart a fluffy raised or lofted surface effect and texture, often referred to as a fleece surface. Such a raised fleece surface provides an enhanced softness and comfortable hand to the fabric and also increases the insulative value of the fabric, particularly suitable for outerwear apparel such as sweatshirts and lightweight jacket.

As noted previously, although the stitch structure of the fabric 10 may be known, the combination of yarns utilized as the yarns 12, 14, 16 in the present invention is unique and unconventional and achieves unexpected results. Basically, while the face yarn 12 and the pile yarn 16 are comprised predominately of textile fibers which have inherent or additive flame resistant properties, e.g., modacrylic fibers, the middle yarn 14 is comprised substantially entirely of textile fibers without inherent or additive flame resistant properties, e.g., cotton fibers untreated with any flame resistant material, which the conventional wisdom in the industry holds is detrimental to flame retardancy and electric arc resistance. More specifically, in a presently contemplated preferred embodiment of the fabric, the outer yarn 12 comprises a 14/1 count single-ply spun yarn blended of approximately 55% modacrylic fibers and approximately 45% cotton fibers (as measured by fiber weight), the inlaid pile yarn 16 comprises a 10/1 count single-ply spun yarn blended of approximately 55% modacrylic fibers and approximately 45% cotton fibers, and the middle yarn 14 comprises a 14/1 count single-ply spun yarn blended of approximately 80% untreated cotton fibers and approximately 20% polyester fibers.

Thus, this embodiment of the present fabric has only about a 35% content of modacrylic flame retardant fibers, with the remaining content of the fabric, about 65%, being fibers that have no inherent or additive flame resistant properties, whereas by contrast it is conventionally believed that the overall content of a fabric must be predominately flame retardant fibers, and in conventional fabrics utilizing modacrylic fibers as the flame retardant material, it believed necessary that the modacrylic content meet or exceed 55%. An actual run of the fabric was knitted on a Vanguard Supreme circular knitting machine Model No. 45FT/2V to a tubular fabric width of 39 inches with a nominal weight of approximately 14.25 ounces per square yard, and after laundering had a nominal fabric weight of approximately 15.5 ounces per square yard imposed by a shrinkage factor of about 9%. Despite the unconventionally low content of flame retardant modacrylic fibers in the fabric, in arc testing performed of this specific fabric according to the ASTM F1959-2004 standard, the fabric 10 achieved an arc rating of 33.6, in the upper half of the Category 3 range.

By contrast, a comparable conventional three-layer fleece fabric made in the identical stitch structure with an outer yarn of a 14/1 count spun yarn, a middle yarn of a 14/1 count spun yarn, and an inlaid pile yarn of a 10/1 count spun yarn, each of an approximately 55% modacrylic fiber and 45% cotton fiber blend, and comparably knitted to a nominal pre-laundered weight of 14.25 ounces per square yard and post-laundered weight of 16.2 ounces per square yard, achieved only an arc rating of 25.1 when tested by the ASTM F1959-2004 standard, only barely within the Category 3 range. Thus, in these tests, the present fabric remarkably and unexpectedly achieved an arc rating that, is 34.4% greater than a comparable conventional three-ply fleece fabric despite having an overall content of flame retardant yarns that is 20% less than that of the conventional fabric.

As will be understood by persons skilled in the art, the present invention is not limited to the embodiment of the fabric in the accompanying drawing. For example, variations of the circularly knitted three-ply fleece fabric structure described above could utilize an inlay pattern of the pile yarn 16 that repeats over a greater or lesser number of wales and courses in the fabric stitch structure. Likewise, the pile yarn 16 could be inlaid into the needle loops of the middle yarn 14 instead of the needle loops of the face yarn 12, whereby the middle yarn 14 serves as a tie yarn to integrate the pile yarn 16 into the fabric structure. The present invention could also be applicable to other alternative three-ply knit fabric structures as well as to non-knit structures such as woven or non-woven fabrics.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. A textile fleece fabric having a resistance to electrically-generated thermal energy from exposure to momentary electric arcs so as to be suitable for use in safety apparel, the fabric comprising a knit structure having three integrated layers including inner and outer layers on opposite sides of an intervening middle layer, the inner and outer layers being comprised of spun yarn having approximately 55% modacrylic textile fibers which have inherent or additive flame resistant properties and approximately 45% other fibers without inherent or additive flame resistant properties, and the middle layer being comprised substantially entirely of textile fibers without inherent or additive flame resistant properties, the entire fabric comprising approximately 35% flame resistant modacrylic fibers, the yarns of the outer and middle layers being interknitted with one another in a pattern of knit stitches and the yarn of the middle layer being inlaid in spaced-apart stitches of the yarn of the outer layer as a pile yarn having a raised nap forming a fleece surface, the fabric having a Category 3 arc rating greater than 30 as measured by ASTM Standard F1959.

2. A thermal resistant textile fleece fabric according to claim 1, wherein the middle layer is formed of a yarn predominately comprising cotton fibers untreated with any flame resistant material.

3. A thermal resistant textile fleece fabric according to claim 1, wherein the yarns of the inner and outer layers comprise approximately 55% modacrylic fibers and approximately 45% cotton fibers and the yarns of the middle layer comprise approximately 80% cotton fibers and approximately 20% polyester fibers.

4. A thermal resistant textile fleece fabric according to claim 1, wherein the knit structure is a circular knit structure.

* * * * *